US007887367B2

(12) United States Patent
Saur et al.

(10) Patent No.: US 7,887,367 B2
(45) Date of Patent: Feb. 15, 2011

(54) CONTACT HOUSING AND ELECTRICAL CONTACT DEVICE

(75) Inventors: Martin Saur, Salach (DE); Eckhardt Philipp, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/989,843

(22) PCT Filed: Sep. 25, 2006

(86) PCT No.: PCT/EP2006/066677

§ 371 (c)(1),
(2), (4) Date: Mar. 2, 2010

(87) PCT Pub. No.: WO2007/048663

PCT Pub. Date: May 3, 2007

(65) Prior Publication Data

US 2010/0151730 A1 Jun. 17, 2010

(30) Foreign Application Priority Data

Oct. 24, 2005 (DE) ..... 10 2005 050 778

(51) Int. Cl.
*H01R 13/40* (2006.01)

(52) U.S. Cl. ..... 439/595; 439/752

(58) Field of Classification Search ..... 439/595, 439/752, 600, 596, 733.1
See application file for complete search history.

(56) References Cited

U.S. PATENT DOCUMENTS 5,002,504 A 3/1991 Carlson ..... 439/599
5,607,327 A 3/1997 Tsuji et al. ..... 439/752
5,645,453 A 7/1997 Yamaguchi ..... 439/595
6,824,428 B2 * 11/2004 Tabata et al. ..... 439/595

FOREIGN PATENT DOCUMENTS

EP 0994530 4/2000

OTHER PUBLICATIONS

International Search Report, PCT International Patent Application No. PCT/EP2006/066677, dated Nov. 15, 2007.

* cited by examiner

*Primary Examiner*—Javaid Nasri
(74) *Attorney, Agent, or Firm*—Kenyon & Kenyon LLP

(57) ABSTRACT

In a contact housing having a contact chamber for accommodating a contact body which can be inserted into the contact chamber through an assembly opening in a direction of insertion, in an operational position of the contact body in which it is stopped within the contact chamber, at least one element of contact chamber is lying against a stopping surface (support surface), of contact body, which generally points in a direction opposite to the insertion direction in such a way that the removal of the contact body is generally prevented counter to the insertion direction, the present invention provides that a center axis of the assembly opening has a lateral offset transversely to the direction of insertion with respect to a center axis of the stopped contact body; that in the contact chamber, in the direction of insertion, behind the assembly opening, a displaceably situated, elastically flexible spring is provided that extends into the path of the contact body, which narrows the path for the contact body and can be deflected by the contact body, and which is designed to be stressed in an assembly position during the insertion of the contact body.

6 Claims, 2 Drawing Sheets

18
17
1
29
28
15
55
26
27
9
21
19
20
23
32
37
25
30
31
70
71
3
85
II
35
a
b
c
d
e
f
59
61'
61
77
87

CONTACT HOUSING AND ELECTRICAL CONTACT DEVICE

FIELD OF THE INVENTION

The present invention relates to a contact housing.

BACKGROUND INFORMATION

In the automotive field, contact systems are used in electrical plug connections in which the individual contact pieces are attached to, that is, fastened to the electrical lines in a first working step, and in a second working step are latched in the contact chambers of plug contact housings. In this connection, two primary latching mechanisms are used. In the so-called "clean-body contacts", elements of the contact chamber snap into recesses or undercuts of the contact chamber and in this manner latch to the contact pieces. The present invention relates to contact systems for clean-body contacts.

Besides these, there are contact systems having so-called "lance contacts". In the case of these, flexible elements of the contact body latch in recesses or in undercuts in the contact chamber. In both types of primary latching elements, generally, filigree elements of the contact body or the contact chamber are involved, which perform the double function, on the one hand, of bringing the latching surfaces to engagement and, on the other hand, of producing the retention force that might have to be set against a possible traction on the electrical line. The compromise in construction, made in many cases to fulfill this double function, is usually at the expense of the achievable primary retention force.

SUMMARY

An example contact housing according to the present invention may have the advantage that a great primary retention force is achieved by the latching of the contact body behind rigid construction elements of the contact chamber. The primary latching of a clean-body contact is carried out in such a way that the double function (latching and retaining), which was up to now combined in the latching hook of the contact chamber, is separated and subdivided to two construction elements that are independent of each other. Depending on the specific embodiment, the mounted contact bodies can be locked individually or in common, by a simple process.

BRIEF DESCRIPTION OF THE DRAWINGS

An exemplary embodiment of the contact housing according to the present invention, and at the same time of an electrical contact device (in the example, it is a female plug) is shown in the figures and is explained in greater detail.

DETAILED DESCRIPTION OF EXAMPLE EMBODIMENTS

Figure 1:
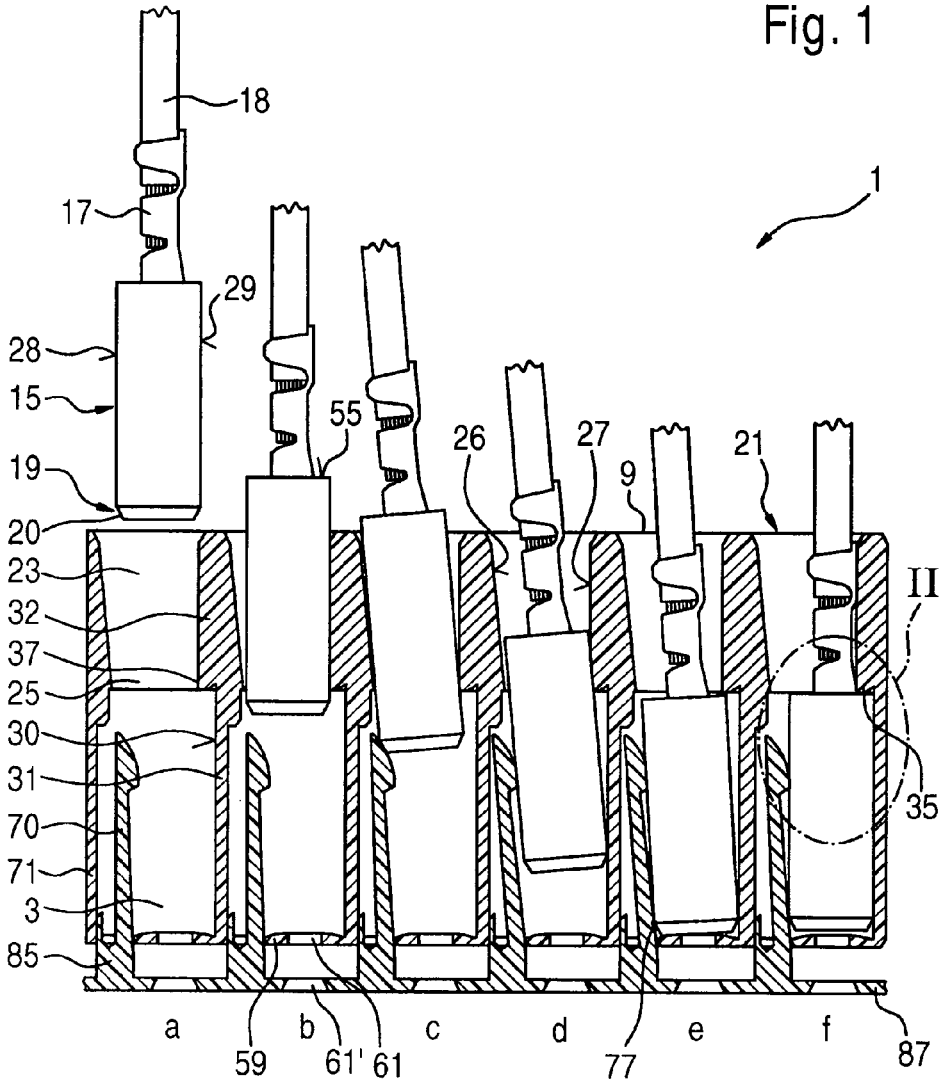
FIG. 1 shows a longitudinal section through a contact housing having a plurality of contact chambers having the springs in the assembly position, several steps of the assembly process being shown.

Contact housing 1 shown in FIG. 1 has six contact chambers 3. These have a common rear panel 9 lying behind the plane of the drawing of FIG. 1, and a front panel lying in front of the plane of the drawing, which is therefore not visible. In the example, all parts of contact housing 1 are made of plastic.

A contact body 15 has a crimped region 17 to which a section of an electrical line 18 is firmly connected. The thickness of contact body 15 (without crimped region 17) at right angles to the plane of the drawing of FIG. 1 is equal to its width that is visible in FIG. 1, but may be selected to be different, depending on requirements. Without crimping region 17, contact body 15 generally has the form of a parallelepiped. At front end section 19, facing away from crimped region 17, contact body 15 has gentle bevels 20.

To explain the sequence of the assembly with contact body 15, lower case letters beginning with "a" on the left have been entered below contact chambers 3 in FIG. 1, which denote the individual assembly steps.

Figure 2:
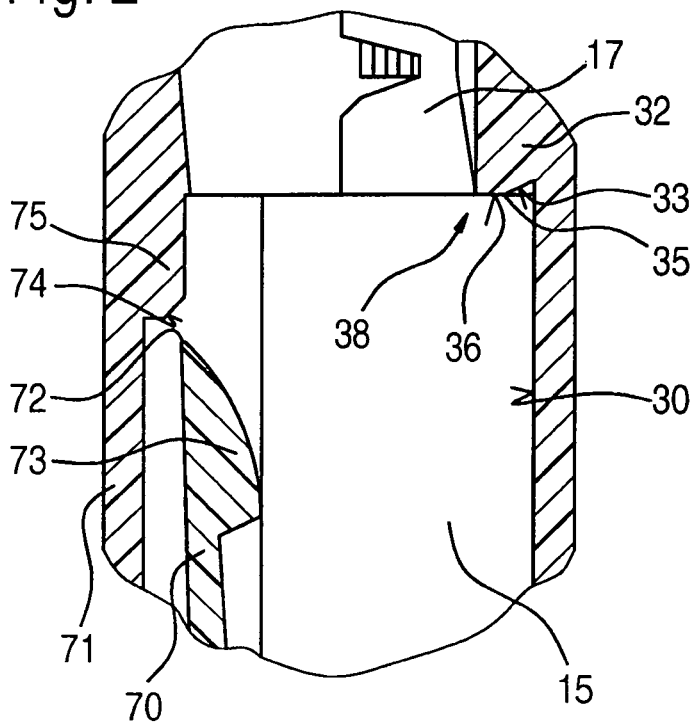
FIG. 2 shows an enlargement essentially corresponding to detail II in FIG. 1.

At step a, contact body 15 is placed with its front end region 19 near an assembly opening 21 from above, in FIG. 1. By comparison with step f, which shows contact body 15 in its completely inserted and positioned location, one can recognize that assembly opening 21 in its upper region 23, that has been widened for easier insertion, and in its lower narrowed region 25 has been offset with respect to the end position that fully inserted contact body 15 occupies. Both lateral surface 26 on the left in FIG. 1 and lateral surface 27 of assembly opening 21 in FIG. 1 on the right, and running exactly from top to bottom, lie further to the left than left surface 28 or right surface 29 of a completely mounted contact body 15, whose right side is supported at right surface 30 on wall 31, as shown in step f. A limiting wall 32, limited on one side by side surface 27 of assembly opening 21 is connected to wall 31. At the upper end of its surface 30 there is a flat adjoining surface 33 (see FIG. 2) which, advantageously, as in the example, subtends an acute angle of slightly less than 90° with surface 30. In other specific embodiments the angle is 90°. Surface 33 forms an undercut, and at an edge 35 it changes into a surface 36. It runs at a right angle to surface 30 and subtends an angle of 90° with lower edge region 37 of side surface 27. With its lower area, that is limited by surfaces 35 and 36 and by the lower part of side surface 27, limiting wall 32 forms a strong latching shoulder 38. Next to its crimping region 17, contact body 15 has a rear support area 55 (or contact shoulder or latching surface) by which contact body 15 is supported on latching shoulder 38 against being pulled out when contact body 15 is mounted in contact chamber 3.

A spring 70, that is situated in contact chamber 3, extends into the path of contact body 15 that is to be pushed in in steps a and b, the spring being adjacent to a side wall 71 that lies opposite to surface 30. Spring 70 is able to be displaced in its position within contact chamber 3. Spring 70 has a front edge 72 and a bulge 73 directed towards surface 30. Spring 70 is situated with its front edge 72 at a distance behind assembly opening 21, close to its side surface 26 that is on the left in FIG. 1. Spring 70 thereby narrows assembly opening 21, and when the insertion takes place, contact piece 15 presses spring 70 elastically in the direction of side wall 71, which can be supported by bevels 20, see step c. In this process, front edge 72 is tilted in front of a stopping surface 74 of an offset 75. At the same time, contact piece 15 is tilted and now points, with its front end region 19, slantwise in the direction towards surface 30, and is inserted further in this direction, see step d. As soon as contact body 15 slides past edge 35 with its rear support surface 55, (step e), spring 70 tilts contact body 15 (step f) and puts it into that position in which it lies fully against surface 30. Its front end region 19, in this context, is enclosed between a point 77 of spring 70 and surface 29. Contact chamber 3 is closed at this location by a bottom 59 in such a way that contact body 15 is retained in contact chamber 3. The bottom has a straight-through recess 61, through which a contact pin (not shown) can penetrate into a female contact (also not shown) that is developed in contact body 15, and produce an electrical connection with it, when the contact device has been fully mounted. Spring 70 acts like a deflecting element and as force storage for moving contact body 15.

If an attempt is made to pull line 18 towards the top left in FIG. 1, contact body 15 will try to position itself slantwise, in order to assume a position similar to the one in step e. In this instance, support surface 55, that runs at right angles to the longitudinal direction of contact body 15, engages behind edge 35. This (and also spring 70) counteracts the tilting of contact body 15.

Only for the insertion of contact body 15 is spring 70 located in the assembly position in which it permits this insertion. For spring 70 is displaceable, using a carrier 85 within contact chamber 3, from the assembly position that is at a slight distance from assembly opening 21 to a locking position situated near assembly opening 21. In the example, spring 70 is supported displaceably. Preferably, and as provided in the example, several springs 70, in particular all springs 70, are connected by a connecting piece 87 that connects carriers 85, and can therefore be moved in common. When all contact pieces 15 are correctly positioned in contact chambers 3, all springs 70 have their tension relieved to the extent that their front edge 72 cannot come into contact with stopping surface 74, and therefore springs 70 can be pushed into the latching position. While one of contact bodies 15 is pushed in, or when contact body 15 remains standing still during the insertion, for instance, in the position according to step e, spring 70 is elastically bent so far that stopping surface 74 is located before front edge 72. Shifting spring 70 in the direction towards assembly opening 21 is therefore prevented. Thereby the shifting of connecting piece 87 is altogether prevented. This applies even if only one of contact pieces 15 has not reached its final position according to step f. The equipment therefore has a detecting function for erroneously positioned contact bodies 15. In the brought-forward latching position of springs 70, the latter support themselves, in the vicinity of their end region, that is close to front edge 72, on shoulder 75 in such a way that contact piece 15 is held in place in contact chamber 3, at this time not by spring force, but by form locking (having slight play, if desired), and pulling it out with the aid of line 18 is not possible.

Figure 3:
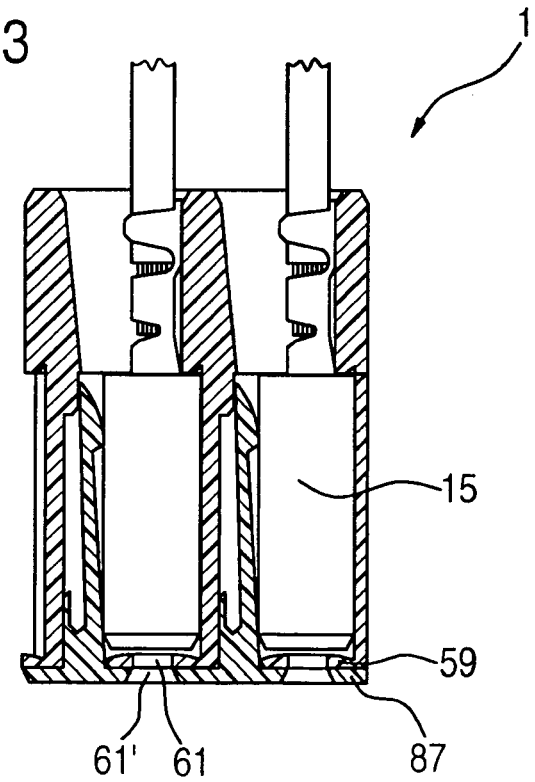
FIG. 3 shows the right part of FIG. 1 after the shifting of the springs into the locking position.

In FIG. 3, connecting piece (or retaining plate) 87 lies totally against bottom 59 of contact chambers 3. It has recesses 61' which align with recesses 61.

During the assembly process, spring 70 can be pressed outwards by contact body 15. Contact chamber 3, in addition, provides an undercut (edge 35), situated opposite spring 70, which is in a position to cover the contact shoulder (support surface 55) of contact body 15, and thus to accommodate the primary retaining force. For this, it is necessary that contact body 15 have a pronounced shoulder (or an appropriate recess in contact body 15) below crimping region 17, behind which the rigid and stable undercut of contact chamber 3 can engage.

During the assembly of contact body 15 into contact chamber 3, the arrangement of contact body 15 and electric line 18 buckles slightly above crimping region 17. Consequently, the main axis of contact body 15 tilts away from the assembly direction. In this way, contact body 15 can slide past the undercut in contact chamber 3.

On the opposite side of the undercut, spring 70 is pressed outwards by the front part of contact body 15 moving in. This is how the contact force of spring 70 is built up, that presses contact body 15 with its shoulder under the cover of the undercut on the opposite side, when it has reached its end position of being fully pushed in. The main axis of the contact tilts back into the assembly direction, during this phase. The contact force and a preferably sharp angle of the undercut provide that contact body 15 cannot be pulled out of its latching position by a tug on electric line 18, during the further mounting process.

In the mechanical way of looking at it, the arrangement of contact body 15 and electric line 18 represents a link chain system which, in the pushing phase of the assembly process is able to adapt to the formations of contact chamber 3 by the inclination of the individual links. By contrast, in the retaining case of the primary latching (that is, in response to a tensile stress on electric line 18), the links of the mechanical chain align themselves corresponding to the force sequence of the tensile stress. In this way, the contact cannot be pressed or pulled from the covering of the undercut (that is, from the engaging over the undercut), and thus out of its latching position. Because of this constructive attainment of the objective, it is possible, for the first time, to implement very high contact retaining forces in contact chamber 3, without loading the possibly filigree flexible elements with just these retaining forces. In addition, using such a latching principle, one is able to implement a very smooth contact body 15.

Designs are made possible by projections in the chamber and appropriate recesses in the contact body, in which the contact body is displaceable by the spring, laterally to the insertion direction, only when the contact body has been pushed in over its entire length. Contact housing 1 can have any number of contact chambers 3, and also, in particular, just one single contact chamber 3. The fully assembled electric contact device may, as in the example, provide female contacts that can be brought to plug connection using contact pins which penetrate into contact chamber 3 and the contact body through an opening at a location that is at a distance from assembly opening 21. It is clear that the contact body can instead have a contact pin having a round or a flat cross section. The provision of a terminal screw by the contact body also falls under the present invention. Instead of fastening electric lines 18 by crimping to the contact bodies that are to be mounted, electric lines 18 can be connected to the contact bodies by plug connections, before the mounting. In this case it is possible to pull the lines away from the contact bodies after the mounting of the contact bodies in contact chambers 3, that was described in light of the exemplary embodiment. These lines are then used only as aids for the assembly. Contact housing 1 and contact chamber(s) 3 will mostly be made of electrically insulating plastic. In individual cases, production using electrically conductive material, particularly steel, may be expedient.

What is claimed is:

1. A contact housing comprising:

a contact chamber adapted to accommodate a contact body that is insertable into the contact chamber through an assembly opening in a direction of insertion, and, in an operational position, the contact body being stopped within the contact chamber, at least one element of the contact chamber lying against a stopping surface of the contact body, which generally points in a direction opposite to the insertion direction, in such a way that a removal of the contact body is generally prevented counter to the direction of insertion, a center axis of the assembly opening having a lateral offset transversely to the direction of insertion with respect to a center axis of the stopped contact body; and an elastically flexible spring displaceably situated in the contact chamber in the direction of insertion, behind the assembly opening, the spring extending into a path of the contact body narrowing the path for the contact body and adapted to be deflected by the contact body, the spring being adapted to be stressed in an assembly position during the insertion of the contact body and to move the contact body laterally, so that, after full insertion into the contact chamber, the contact body is pressed, by the spring in the contact chamber, with the stopping surface at least partially behind a stationary latching shoulder of the contact chamber, and is further adapted, when the contact body is mounted, to be pushed into a latching position which secures a position of a fully inserted contact piece.

2. The contact housing as recited in claim 1, wherein a front edge of the spring, in response to an elastic deflection by the contact body, is situated in front of a contact chamber stopping surface which prevents a displacement of the spring into the latching position.

3. The contact housing as recited in claim 1, wherein the housing includes a plurality of springs connected to one another by a connecting piece.

4. The contact housing as recited in claim 1, wherein the latching shoulder is situated opposite to the spring that is in the assembly position.

5. The contact housing as recited in claim 1, wherein the latching shoulder in a latching state engages over a support surface of the contact body that faces the assembly opening.

6. The contact housing as recited in claim 1, wherein a part of the spring acting on the contact body is located approximately at a height of a rear end of the fully inserted contact body.

* * * * *